US008056769B2

(12) United States Patent
van der Heijden

(10) Patent No.: US 8,056,769 B2
(45) Date of Patent: Nov. 15, 2011

(54) SQUEEZE FOAMER

(75) Inventor: Edgar Ivo Maria van der Heijden, Broek Op Langedijk (NL)

(73) Assignee: Rexam Airspray N.V., Alkmaar (NL)

( * ) Notice: Subject to any disclaimer, the term of this patent is extended or adjusted under 35 U.S.C. 154(b) by 548 days.

(21) Appl. No.: 12/160,459

(22) PCT Filed: Jan. 23, 2007

(86) PCT No.: PCT/NL2007/000022

§ 371 (c)(1),
(2), (4) Date: Jul. 10, 2008

(87) PCT Pub. No.: WO2007/086730

PCT Pub. Date: Aug. 2, 2007

(65) Prior Publication Data

US 2008/0277426 A1 Nov. 13, 2008

(30) Foreign Application Priority Data

Jan. 24, 2006 (NL) ..... 1030994
Dec. 11, 2006 (NL) ..... 1033031

(51) Int. Cl.
*B67D 5/58* (2006.01)

(52) U.S. Cl. ..... 222/190; 222/211

(58) Field of Classification Search ..... 222/190, 222/211, 209

See application file for complete search history.

(56) References Cited

U.S. PATENT DOCUMENTS

| | | | | |
|---|---|---|---|---|
| 4,773,570 | A | 9/1988 | Workum | |
| 5,037,006 | A | 8/1991 | Kock | |
| 6,394,315 | B1 * | 5/2002 | Banks | 222/190 |
| 6,540,105 | B2 * | 4/2003 | Dorman et al. | 222/1 |
| 7,661,561 | B2 * | 2/2010 | Ophardt et al. | 222/137 |
| 2002/0153389 | A1 | 10/2002 | Creaghan et al. | |
| 2004/0060945 | A1 | 4/2004 | Cater et al. | |

FOREIGN PATENT DOCUMENTS

| | | |
|---|---|---|
| DE | 9110905.1 | 1/1993 |
| WO | 9421374 | 9/1994 |

* cited by examiner

*Primary Examiner* — Kevin P Shaver
*Assistant Examiner* — Donnell Long
(74) *Attorney, Agent, or Firm* — Hoffmann & Baron, LLP

(57) ABSTRACT

The invention relates to a dispensing device for dispensing a foam, comprising a manually compressible container (2) for storing a liquid and air, which container comprises an opening (3), a rigid housing (4, 5) to be fitted in or on the opening, the housing comprising an air passage (11, 12) and a liquid passage (9), which are in communication with a dispensing passage (14) which ends in a dispensing opening (8), and a valve body (6) which, in a rest position, covers a mouth of the liquid passage and a mouth of the air passage (10) in a sealing manner in order to prevent a flow from the liquid passage and the air passage to the dispensing passage, and which, during dispensing, opens the mouth of the liquid passage and the mouth of the air passage in order to allow mixing of air and liquid to take place in the dispensing passage. The invention is characterized by the fact that the mouth of the air passage and the mouth of the liquid passage are—substantially annular and are arranged substantially concentrically with respect to one another.

16 Claims, 4 Drawing Sheets

SQUEEZE FOAMER

CROSS-REFERENCE TO RELATED APPLICATIONS

This application is the National Stage of International Application No. PCT/NL2007/000022, filed Jan. 23, 2007, which claims the benefit of Netherlands Application No. NL 1030994, filed Jan. 24, 2006, and of Netherlands Application No. NL 1033031, filed Dec. 1, 2006, the contents of which are incorporated by reference herein.

FIELD OF THE INVENTION

The present invention relates to a dispensing device for dispensing a foam and a foam-forming assembly for forming a foam. More in particular, the present invention relates to a pumpless squeeze foamer.

BACKGROUND OF THE INVENTION

U.S. Pat. No. 5,037,006 discloses a dispensing device for dispensing a foam. This known dispensing device comprises a manually compressible container for storing a liquid and air. The container comprises an opening in which a housing is fitted. In this housing, a liquid passage and an air passage are arranged which, during dispensing, are in communication with a dispensing passage which ends in a dispensing opening. The dispensing device furthermore comprises a valve body which, in a rest position, seals a mouth of the liquid passage and a mouth of the air passage. The valve body is a disc-shaped flexible element, which is held at the circumference and is pressed against the mouths of the liquid passage and the air passage by means of a spring.

By compressing/squeezing the container, the pressure in the container is increased and thus the pressure in the liquid passage and the air passage. As a result of this elevated pressure, the valve body on the mouths of the air passage and the liquid passage gives way, and a stream of air from the air passage and a stream of liquid from the liquid passage come together in the dispensing passage. In the dispensing passage, the mixture of liquid and air is passed through a number of sieves in order to create a foam, which is dispensed by the dispensing opening.

After the container has been squeezed, the container will essentially return to its original state, either by the elasticity of the container itself or by restoring means which are provided in order to return the container to its original state.

A drawback of the known dispensing device is the fact that the mixture of air and liquid is not optimum, as a result of which the quality of the foam is not satisfactory. In addition, the structure of the known dispensing device is complex and comprises many components, which makes production complicated. In addition, the air passage and the liquid passage are bendy, as a result of which the speed of the liquid and air stream decreases, which consequently also leads to a reduction in the quality of the foam.

SUMMARY OF THE INVENTION

It is an object of the present invention to provide a dispensing device for dispensing a foam which solves one or more of the abovementioned drawbacks.

According to a first aspect of the invention, a dispensing device for dispensing a foam is provided which comprises a manually compressible container for storing a liquid and air, and a foam-forming assembly to be attached in or on an opening in the container for forming a foam, the foam-forming assembly comprising a housing having an air passage and a liquid passage, each of which ending in a mouth and being in communication with a dispensing passage which ends in a dispensing opening, and a valve body which, in a rest position, covers the mouth of the liquid passage and the mouth of the air passage in a sealing manner in order to prevent a flow from the liquid passage and the air passage to the dispensing passage, and which, during dispensing, opens the mouth of the liquid passage and the mouth of the air passage in order to allow mixing of air and liquid to take place in the dispensing passage, which is characterized by the fact that the mouth of the air passage and the mouth of the liquid passage are substantially annular and are arranged substantially concentrically with respect to one another.

By making the mouth of the air passage and the liquid passage of annular design, the amount of liquid to be dispensed and air to be mixed with the latter is distributed over as large a surface area as possible. As the two annular mouths are arranged substantially concentrically with respect to one another, an improved mixture between the liquid and the air stream is obtained.

In this respect it is remarked that the annular mouth of the liquid passage and/or air passage may be formed by one substantially annular mouth or by a number of openings which are arranged in a circle.

In one embodiment, the diameter of the annular mouth of the liquid passage is greater than the diameter of the annular mouth of the air passage. As a result thereof, the liquid, which flows from the annular mouth of the liquid passage, will flow past the annular mouth of the air passage when the foam is being dispensed and a good mixture will be achieved.

In one embodiment, the valve body is substantially conical. The term conical is understood to mean that the valve body is of substantially circular-symmetrical design and that, in the direction of the center axis of symmetry, the diameter is greater at one end of the valve body than at the other end of the valve body. The diameter may become increasingly smaller over the entire length, but may also increase or remain constant over part of the length of the conical shape.

In one embodiment, the valve body is at least partly made from a flexible, preferably elastic, material, for example silicone, such as for instance Liquid Silicone Rubber (SLR). By manufacturing the valve body from a flexible material, there is no need to install any further moving components in the dispensing device in order to provide the valve function of the valve body. By using an elastic material, the valve body will return to its rest position after a foam has been dispensed as a result of the container having been squeezed. However, this return movement may also be effected in any other suitable way, for example by using a spring element or by pretensioning the valve body.

In one embodiment, the housing is substantially circular-symmetrical about a center axis and/or the liquid to be dispensed, during dispensing, moves in a direction relative to the longitudinal direction of the housing. In such an embodiment, the liquid does not have to follow complicated flow paths in which the main direction of the liquid is reversed two times or more. This also allows a relatively simple construction of the dispensing device.

According to a second aspect, the invention provides a foam-forming assembly for forming a foam, comprising a housing having an air passage and a liquid passage, each of which ending in a mouth and being in communication with a dispensing passage which ends in a dispensing opening, and a valve body which, in a rest position, covers the mouth of the liquid passage and the mouth of the air passage in a sealing manner in order to prevent a flow from the liquid passage and the air passage to the dispensing passage, and which, during dispensing, opens the mouth of the liquid passage and the mouth of the air passage in order to allow mixing of air and liquid to take place in the dispensing passage, which is characterized in that a constriction is arranged in said dispensing passage, preferably upstream of a porous element or sieve element arranged in the dispensing passage.

By arranging a constriction in the dispensing passage it is possible to accelerate in the dispensing passage the foam flow or liquid-air mixture flow. As a result, the mixing and thus the foam-forming is improved. Preferably, the constriction is arranged upstream with respect to a porous element or sieve element arranged in the dispensing passage, so that after the acceleration, the foam or the liquid-air mixture, is put through the porous element or sieve element to improve the forming of the foam. It has been found that the provision of a constriction results in a considerable improvement of the quality of the foam. The cross section surface area of the constriction is preferably less than 75% of the cross section surface area of the dispensing passage, more preferably less than 50%.

According to a third aspect, the invention provides a dispensing device for dispensing a foam, which is characterized by the fact that the valve body comprises a through-opening which forms part of the dispensing passage. By allowing the liquid to flow through the through-opening in the valve body, it is not necessary to turn the liquid passage and the air passage around twice in order to achieve communication with the dispensing passage. This results in a relatively simple construction of the dispensing device.

The foam-forming assembly according to the invention may advantageously be applied in a squeeze foamer comprising a manually compressible container for storing a liquid and air, the foam-forming assembly mountable on or in an opening of said container.

In alternative embodiments of dispensing devices for dispensing a foam, a foam-forming assembly according to the invention may be arranged in or on a container holding a liquid and gas under pressure, for instance on a container with a foamable liquid and a propellant. Also, the foam-forming assembly may be combined with any other device which can provide a foamable liquid and gas under pressure, for instance a device having a liquid pump and an air pump or a device having a liquid supply and air supply which are continuously under pressure.

BRIEF DESCRIPTION OF THE DRAWING

The invention will be explained in more detail below by means of an exemplary embodiment in which reference will be made to the attached drawing, in which.

DETAILED DESCRIPTION OF PREFERRED EMBODIMENTS

Figure 1:
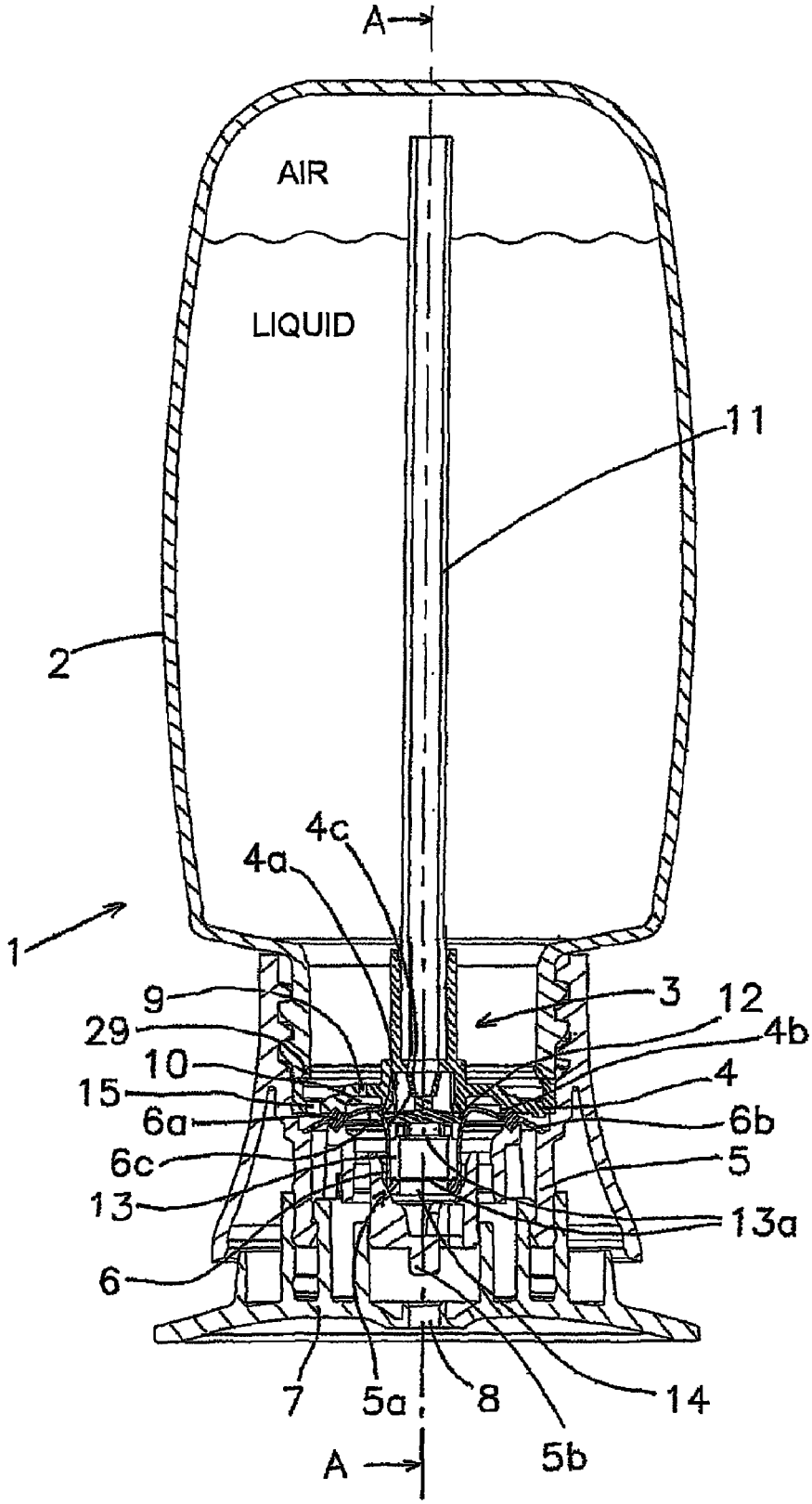
FIG. 1 shows a cross section of a first embodiment of a dispensing device according to the invention.
Figure 2:
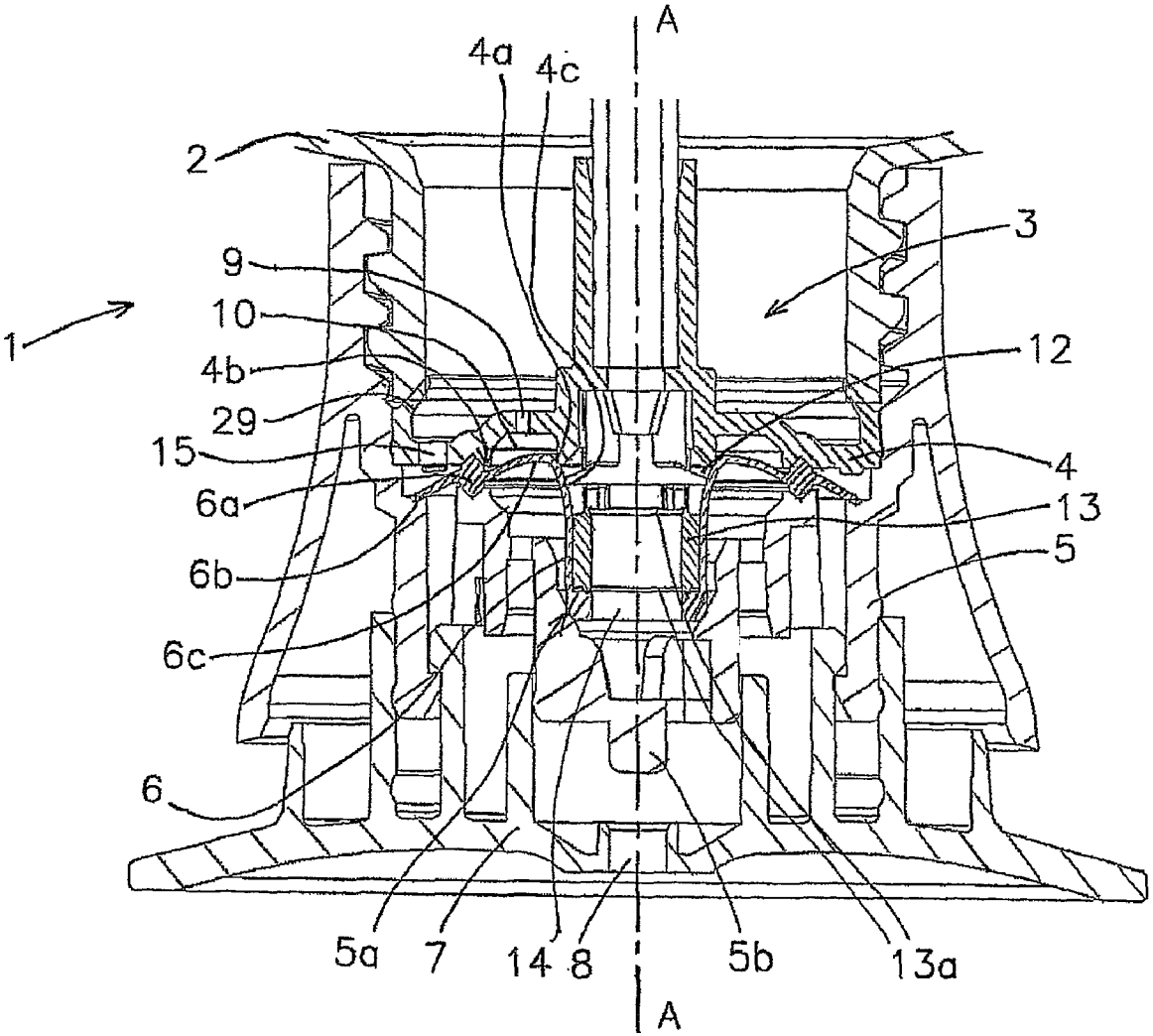
FIG. 2 shows a part of the dispensing device from FIG. 1 in more detail.

FIGS. 1 and 2 show a first embodiment of a dispensing device according to the invention. The dispensing device is denoted overall by reference numeral 1. The dispensing device 1 is of the squeeze foamer type. Such a squeeze foamer generally dispenses a foam through a dispensing opening as a result of a container being squeezed. After it has been squeezed, the container will return to the original state, either by the elasticity of the container itself or by restoring means which are provided in order to return the container to its original state.

The foam which can be formed using the dispensing device 1 may be suitable for various different uses, such as, for example, as soap, shampoo, shaving foam, washing-up liquid, sun-tan lotion, after-sun lotion, washing liquid, skincare products and the like.

The dispensing device is shown in the rest position, that is to say that the container is not being squeezed. Such a squeeze foamer can be operated by hand. However, it is also possible to push the container in using a device intended for the purpose.

The illustrated squeeze foamer can be held in a hand during delivery. It is also possible to install it or a similar dispensing device into a holder which is to be attached, for example, to the wall, similar to holder which can, for example, be found in public toilets.

The dispensing device 1 comprises a manually compressible container 2 containing a liquid and air. The container has an opening 3 in which a foam-forming assembly is fitted. The container 2 may have any suitable shape, for example a shape having an elliptical or a circular cross section.

The foam-forming assembly is substantially circular-symmetrical around a center axis of symmetry A-A. The foam-forming assembly comprises a housing with a first housing part 4 and a second housing part 5. The second housing part 5 is attached to the container 2 by means of a threaded connection, the first housing part 4 being clamped in a sealing manner between the container 2 and the second housing part 5. Alternatively, the second housing part 5 may be attached by means of a snap connection, a welded connection, an airtight seal or another suitable connection on or in the container 2. Furthermore, the foam-forming assembly comprises a substantially conical valve body 6 which is clamped near clamping section 6*a* between the first housing part 4 and the second housing part 5. The valve body 6 is made from a flexible, preferably elastic material. Silicone has proved to be a particularly suitable material for the valve body 6.

Relative to the liquid, the air is situated at the top of the container 2. This liquid and this air can be turned into a foam by means of the dispensing device 1, which is dispensed through a dispensing opening 8 in the sealing cap 7. In order to make mixing of the liquid and the air possible, a liquid passage is provided which runs from the liquid in the container via an opening 9 in the first housing part 4 to an annular mouth 10 (between the circular edges 4*a* and 4*b*) of the liquid passage.

For the air, an air passage is provided which runs from the air at the top of the container 2 via the tube 11 to an annular mouth 12 (between the circular edges 4*a* and 4*c*) of the air passage. In the rest position shown, both the annular mouth 10 and the annular mouth 12 are sealed by the valve body 6. When the two annular mouths 10, 12 are opened, that is to say not sealed by the valve body 6, the liquid passage and air passage are in communication with a dispensing passage. The dispensing passage runs through the central part of the valve body 6, in which a sieve element 13 with two small sieves 13*a* is arranged, through a central opening 14 of the valve body 6, through the second housing part 5 and the sealing cap 7 to the dispensing opening 8.

As a rule, the air passage contains one or more air ducts which bring the air in the container in fluid communication with a mouth of the air passage which, in the rest position, is covered by the valve body. The liquid passage correspondingly contains one or more liquid ducts which bring the liquid in the container in fluid communication with the mouth of the liquid passage which, in the rest position, is covered by the valve body.

The annular mouth 10 of the liquid passage, the annular mouth 12 of the air passage and the dispensing passage are arranged substantially concentrically with respect to one another. The diameter of the annular mouth 10 is in this case larger than the annular mouth 12. Furthermore, the inner diameter of the central passage 14 in the valve body 6 is smaller than the diameter of each of the annular mouths 10 and 12. Now, the valve body 6 will be discussed in more detail. At the point 6*a*, the valve body 6 is sealingly clamped between the first housing part 4 and the second housing part 5. Furthermore, the valve body is retained by the annular edges 4*a* and 4*c* against the conical surface 5*a*. In order, in the rest position, to achieve a better sealing along the circular edges 4*a* and 4*c*, the valve body 6 is fitted with some axial pretension between the first housing part 4 and the second housing part 5.

The valve body 6 has an arcuate section 6*c* which is located, at least partly, in the annular mouth 10 of the liquid passage. This arcuate section 6*c* has the advantage that, as a result of the liquid column in the container and the liquid passage which, in the rest position, presses on the valve body, an improved sealing is obtained at point 4*a*. This is due to the fact that the arcuate section 6*c* is pushed in, as a result of which the sides of the arch are pushed sideways. As a result, the outside of the arcuate section 6*c* is pushed towards the clamp 6*a*, and the inside of the arcuate section 6*c* is pushed against the circular edge 4*a* as well as against the circular edge 4*c*, which increases the sealing action.

In this case, it is particularly advantageous that the cross section of the arcuate section 6*c* which extends inside the annular mouth 10 is not of a symmetrical design, but that a top of the arcuate section 6*c* is situated relatively close to the edge 4*a*, i.e. that the top of the arcuate section 6*c* is closer to the edge 4*a* than to the edge 4*b*. As a result of this shape, the arcuate section 6*c* will, under the pressure of the liquid column, in particular press against the edge 4*c*, resulting in a good sealing here. As the annular mouth 10 is sealed on the other side by the clamp at section 6*a*, the mouth is efficiently sealed off by the valve body 6 without a great clamping force being required.

In an alternative embodiment in which the valve body 6 is not clamped to one of the sides of the mouth, a top can be provided near both edges of the mouth in order to achieve the advantageous very strong clamping effect of the arcuate section of the valve body on both edges. The cross section of the arcuate section of the valve body then resembles the back of a camel, the two tops of the valve body representing the humps of the camel.

On the side situated on the outside of the clamping section 6*a*, the valve body 6 has a sealing lip 6*b* which serves as a valve for an air inlet valve which allows air into the container 2 when a certain reduced pressure is created in the container 2 as a result of the liquid in the container 2 being dispensed. The sealing lip 6*b* normally seals the passage of the container 2 towards the outside, but will allow a flow of air from outside into the container 2 through the opening 15 when there is a reduced pressure in the container 2.

The dispensing device 1 furthermore comprises a sealing cap 7. Relative to the second housing part 5, this sealing cap 7 can be moved at least into an open position, as shown in FIGS. 1 and 2, and a closed position (towards the top in the drawing, relative to the housing). In the closed position, a projecting section 5*b* of the second housing part 5 is moved into the dispensing opening 8 so that no foam can be dispensed through the dispensing opening 8. The air inlet passage which, via the valve body 6*b* and the opening 15, leads to the interior of the container 2, is sealed when the sealing cap is placed in the closed position. The sealing cap 7 still has a number of upwardly pointing fingers which engage with complementary fingers on the second housing part 5. These intermating fingers form further sealings in the closed position.

Near its outer periphery, the first housing part 4 has a free projecting lip 29 which extends obliquely in the direction of the container 2 and inwards (towards the centre line A-A). This lip 29 serves as a sealing element for sealing the connection between the first housing part 4 and the container 2. Such a sealing is also known as a crab claw, but has not yet been used in a foam-dispensing device, in particular not in a squeeze foamer.

When the container 2 is squeezed in the open position of the sealing cap, the pressure in the container 2 will increase. Initially, the increasing pressure will ensure that the arcuate section 6*c* of the valve body 6 is pressed more strongly against the annular edge 4*a*, resulting in an improved sealing between the valve body 6 and the annular edge 4*a*. When the pressure in the container 2 is increased further by squeezing the latter, the arcuate section 6*c* will at some point move down, as a result of which it will detach from the annular edge 4*a*. This will lead to a stream of liquid flowing through the gap between the annular edge 4*a* and the valve body 6. As a result of the increasing pressure in the container 2, the valve body 6 will subsequently also become detached from the annular edge 4*c*, making it possible for air and the stream of liquid to flow between the annular edge 4*c* and the valve body 6. Here, the liquid will thus be mixed with the air. Since both the liquid and the air will flow through a narrow circular gap, a good mixture between the air and the liquid will result. This mixture of air and liquid will then flow through the small sieves 13*a*, which will produce an (improved) foam. This foam will flow down through the dispensing passage towards the dispensing opening, where it will be dispensed.

The valve body 6 thus as it were successively rolls over the annular edges 4*a* and 4*c* during dispensing as a result of which the liquid and air can flow via the dispensing passage to the dispensing opening, creating a foam in the dispensing passage. It has been found that this rolling effect is advantageous for forming a foam.

A first advantage of the embodiment of the dispensing device 1 is that the annular mouths of the liquid passage and the air passage distribute the liquid and the air over a relatively large surface area, resulting in a relatively good mixing. Incidentally, this advantage is also achieved when one or both of the annular mouths extend over less than 360 degrees or are subdivided into several openings which together form an interrupted annular opening. Such embodiments are considered to fall within the scope of protection of the invention.

In an alternative embodiment, it is possible to design the valve body to be stiff and to press or pull it against the first housing part 4 using a spring element. When the pressure in the container is increased, the spring will then be compressed or extended, respectively, creating a gap between the valve body 6 and the second housing part 4. As a result, it will be possible to form and to dispense a foam. However, in such an embodiment the advantageous rolling effect described above will not occur.

A second advantage of the embodiment of the dispensing device 1 is that as a result of the central opening 14 which is provided in the valve body, the stream of liquid and/or the stream of air does not have to turn corners of 90 degrees or more. By providing this opening 14, the stream of liquid and the stream of air can maintain their speed, thus resulting in a better mixture of the liquid and the air. In this case, it is furthermore advantageous that the valve body 6 is designed to be substantially conical as a result of which the speed of the stream of liquid and the stream of air is maintained even more effectively. In addition, the conical shape has the advantage that a sieve element assisting the production of foam can be fitted in the cone. By fitting it in the conical shape, the total height of the housing is reduced, Generally, the illustrated embodiment of the dispensing device has the advantage that the liquid to be dispensed moves in a direction relative to the direction of the center axis of symmetry while it is being dispensed. This is made possible by the specific construction of the dispensing device and aids the production of a foam of the desired quality.

A third advantage of the embodiment of the dispensing device 1 is that the arcuate section 6*c* of the valve body 6 supports the sealing between the second housing part 4 and the valve body 6. As a result, a better sealing is achieved in the rest position, i.e. when the container 2 is not being squeezed, thus reducing the risk of liquid leaking from the dispensing device. In addition, the arcuate section 6*c* creates a pressure threshold value, at which the valve body becomes detached from the second housing part 4, ensuring an improved foam of constant quality.

Figure 3A:
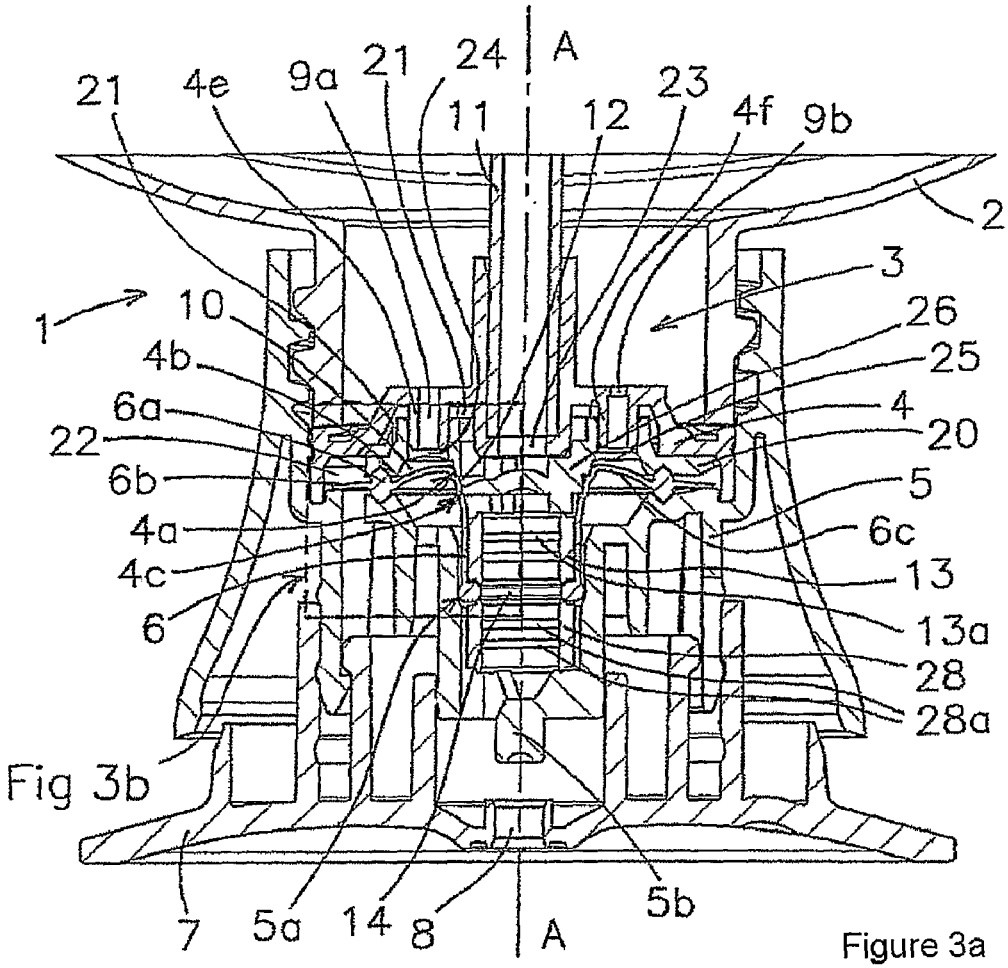
FIG. 3*a* shows a cross section of a second embodiment of a dispensing device according to the invention.
Figure 3B:
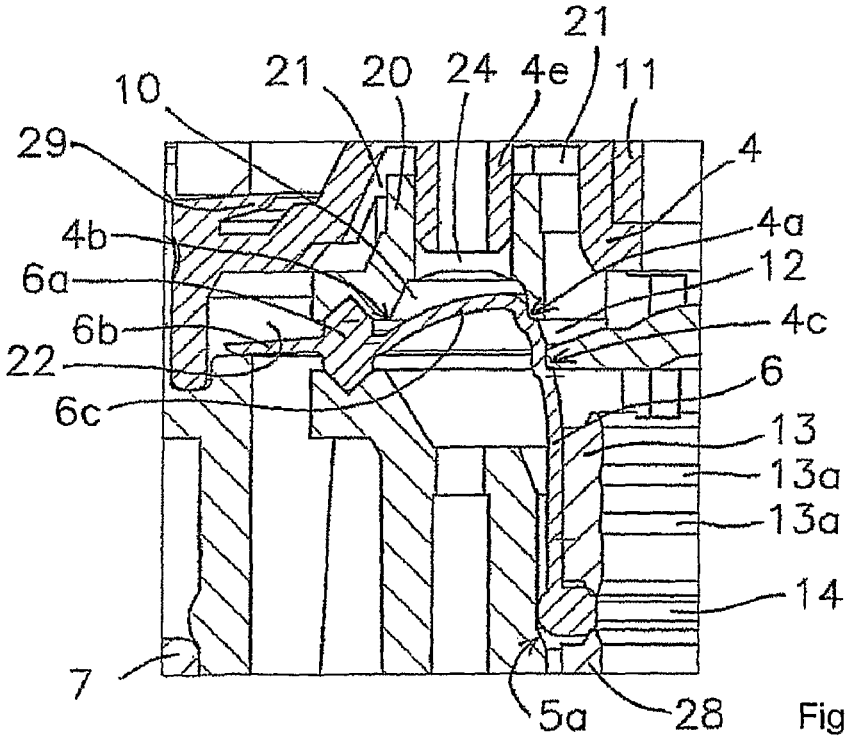
FIG. 3*b* shows a part of the dispensing device from FIG. 3*a* in more detail.

FIG. 3 (i.e. FIGS. 3*a* and 3*b*) shows a second embodiment of a squeeze foamer according to the invention. This squeeze foamer is generally constructed in accordance with the embodiment shown in FIGS. 1 and 2. Therefore, identical reference numerals have been used to denote substantially identical components of this squeeze foamer. Furthermore, the above-described operation of the squeeze foamer according to FIGS. 1 and 2 generally also applies to the embodiment from FIG. 3.

The most important difference between the squeeze foamer from FIGS. 1 and 2 and the squeeze foamer from FIG. 3 is that the latter comprises a third housing part which is denoted in FIG. 3 by the reference numeral 20. As a result of this additional housing part 20, the squeeze foamer from FIG. 3 has a number of added advantages, as will be described below.

The third housing part 20 is clamped between the clamping section 6*a* on the valve body 6 and the first housing part 4. In this embodiment, the valve body 6 is thus clamped between the second housing part 5 and the third housing part 20. The first housing part 4 comprises sleeves 4*e*/4*f*, in which the openings 9*a* and 9*b*, respectively, are provided. These sleeves 4*e*/4*f* are placed in an opening 24 of the third housing part in a sealing manner.

The liquid which flows through the opening 9*a* to the annular mouth 10 is thus not able to reach a space 21 which is situated between the first housing part 4 and the third housing part 20. This space 21 connects the space 22 just above the air inlet valve 6*b* to the interior of the riser 11. As a result, the air which enters through the air inlet valve 6*b* during aeration of the container 2 following the dispensing of a certain amount of liquid, will successively flow through the spaces 22 and 21 and through the riser 11 into the top section of the container 2. Compared to the embodiment of FIGS. 1 and 2, the air is prevented from passing through the liquid in the container 2 prior to the aeration of the container 2. The latter has the disadvantage that a foam may already be formed in the container 2 as the air required for aerating the bottle flows through the liquid.

By forming a space 21 using a third housing part 20, the production of foam in the container 2 during aeration is thus prevented in a constructionally simple manner. In an alternative embodiment, it is possible, for example in the embodiment from FIGS. 1 and 2, to provide an air duct through the first housing part 4 or the second housing part 5, which air duct connects the air inlet valve with the interior of the riser, so that the container can be aerated without air having to flow through the liquid in the container.

Another advantage of the embodiment of the squeeze foamer from FIG. 3 is the fact that, by providing the third housing part 20, it is possible, in a simple manner, to make the squeeze foamer capable of supplying a foam with two or more air/liquid ratios, as will be explained in more detail below.

Figure 4:
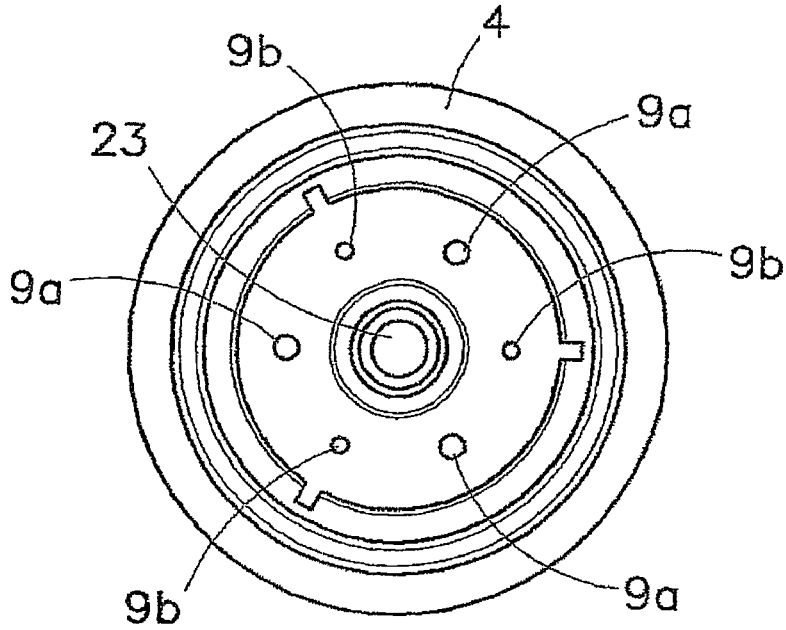
FIG. 4 shows a top view of the first housing part of the embodiment from FIG. 3.

FIG. 4 shows a top view of the first housing part 4. This first housing part 4 is substantially circular and comprises a central opening 23 surrounded by six openings, three openings 9*a* having a larger diameter than the other three openings 9*b*. While foam is being dispensed and also during aeration of the container 2, air will flow through the central opening 23. Depending on the desired air/liquid ratio, one or more of the openings 9*a* and 9*b* are provided in order to allow liquid to flow through them while the squeeze foamer is being operated.

Figure 5:
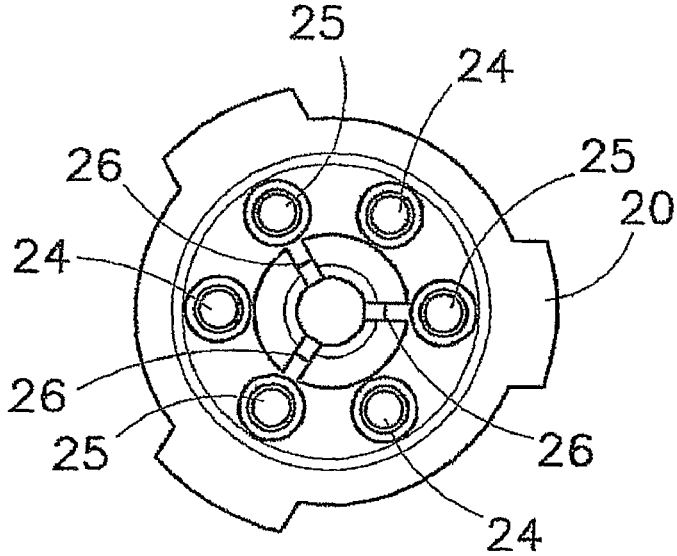
FIG. 5 shows a top view of the third housing part of the embodiment from FIG. 3.

FIG. 5 shows a top view of the third housing part 20. This third housing part 20 comprises three openings 24 which can be brought in line with either the large openings 9*a* or the small openings 9*b* of the first housing part 4, depending on the position of rotation in which the third housing part 20 is placed on the first housing part 4. The third housing part 20 furthermore comprises three blind holes 25 which, depending on the position of the first housing part 4 relative to the second housing part 20, will either seal the large openings 9*a* or the small openings 9*b*.

FIG. 3 clearly shows, on the left-hand side, that the sleeve 4*e* of the first housing part 4, in which the opening 9*a* is provided, is positioned in the sleeve, in which the opening 24 is provided, while the sleeve 4*f*, shown on the right-hand side in the figure, in which the opening 9*b* is provided, is sealed by the blind hole 25. During operation of the squeeze foamer 1, the liquid will therefore only flow through the three large openings 9*a*.

If the first housing part 4 and the third housing part 20 were now to be rotated 60 degrees with respect to one another, the openings 24 would be lined up with the small openings 9*b*, while the large openings 9*a* would be sealed by the blind holes 25. This would result in less liquid flowing from the openings 9*b* during operation of the squeeze foamer, whereas the amount of air which flows through the riser 11 as a result of the container 2 being squeezed would remain virtually the same. Thus, the air/liquid ratio will change depending on the position of rotation of the first housing part 4 relative to the third housing part 20.

It will be clear to the person skilled in the art that this construction offers many possibilities for changing the air/liquid ratio by varying the number of openings in the first housing part which are optionally sealed by a blind hole as well as by varying the size of the respective openings.

A further possibility to influence the air/liquid ratio is through the adjustment of the smallest diameter of the air passage, for example by adjusting the inner diameter of the riser 11 or by adjusting the diameter of the central opening 23 in the first housing part 4. The options which have been given for adjusting the air/liquid ratio can also be used to affect the total amount of foam which is formed when the container 2 is squeezed.

In the present embodiment of FIG. 3, only two positions are possible: one as shown in FIG. 3, where the liquid is dispensed through the three large openings 9*a*, and a position in which the first housing part 4 is rotated by 60 degrees relative to the third housing part 20 and in which the liquid is thus dispensed through the three small openings 9*b*. When fitting the various components of the squeeze foamer 1 onto the container 2, a choice will be made regarding the position in which the first housing part 4 would be fitted with respect to the third housing part 20, for example depending on the liquid.

FIG. 5 furthermore shows that the central section and the outer section of the third housing part 20 are connected to one another by bridge parts 26. These bridge parts 26 result in the mouth 12 being formed by three openings, which openings are arranged in a ring shape. Such an embodiment of the mouth 12 with several openings is deemed to be a substantially annular mouth as referred to in the context of the present patent application.

A further difference between the embodiment from FIG. 3 and the embodiment from FIGS. 1 and 2 is that, in the embodiment from FIG. 3, a second sieve element 28 comprising two small sieves 28*a* is provided. Depending on the foam to be formed and the liquid which is used for this purpose, this second sieve element 28 may be used to further affect the quality of the foam to be dispensed. In general, the provision of additional sieve elements will result in the foam becoming more refined and also more homogeneous. Depending on the application, it is thus possible to choose one of the sieve elements 13, 28 or the combination thereof, it also being possible to modify the type of small sieve which is used in the respective sieve elements 13, 28 to suit the application. In an alternative embodiment, the sieve elements 13, 28 can also be designed as a single sieve element, half of this single sieve element extending into the valve body.

In the embodiment of FIGS. 3*a* and 3*b*, one of the small sieves 13*a* is replaced by a small plate 13*b* having one or more relatively small holes, giving the sieve element also the function of an expansion space.

In the dispensing passage a constriction element 13*b* is formed which constricts the cross section surface area of the dispensing opening at the constriction. The constriction causes an acceleration of the foam flow or liquid-air mixture flow in the dispensing passage therewith improving the quality of the foam. The constriction element 13*b* is designed integrally with the sieve element 13. In another embodiment the constriction element can be provided by a separate element or an element integrated in another part of the foam-forming assembly.

The cross section surface area of the constriction element is preferably maximally 75%, more preferably maximally 50%, of the cross section surface area of the dispensing passage upstream of the constriction.

The constriction is arranged upstream of at least one of the sieves 28*a*, or generally before the last porous element or sieve element. By arranging the constriction upstream of at least one of the sieves, the forming of foam is further positively influenced.

The above-described embodiments of a squeeze foamer have been described in a position where the cap points downwards. All references to above and/or below are made relative to this position. The dispensing device is designed to be used in this position. In this case, the sealing cap 7 is designed such that the dispensing device can stand on this sealing cap 7, whereas the container 2, due to its convex top, is not suitable to stand on this top. However, it is possible to provide an embodiment in which the dispensing device can indeed be turned upside down (inverted with respect to the position shown) in order to dispense foam and/or rest. Such embodiments are deemed to fall within the scope of protection of this invention.

It will be clear to the person skilled in the art that all individual features which have been mentioned with respect to one of the aspects can also be applied in an embodiment according to one of the other aspects of the invention. Such embodiments are thus deemed to fall within the scope of protection of the invention.

What is claimed is:

1. A dispensing device for dispensing a foam, comprising:
- a manually compressible container for storing a liquid and air, and
- a foam-forming assembly to be attached in or on an opening in the container for forming a foam, the foam-forming assembly comprising:
  - a housing having an air passage and a liquid passage, each of which ending in a mouth and being in communication with a dispensing passage which ends in a dispensing opening, and
  - a valve body which, in a rest position, covers the mouth of the liquid passage and the mouth of the air passage in a sealing manner in order to prevent a flow from the liquid passage and the air passage to the dispensing passage, and which, during dispensing, opens the mouth of the liquid passage and the mouth of the air passage in order to allow mixing of air and liquid to take place in the dispensing passage,
- wherein the mouth of the air passage and the mouth of the liquid passage are substantially annular and are arranged substantially concentrically with respect to one another.

2. The dispensing device of claim 1, wherein the diameter of the annular mouth of the liquid passage is greater than the diameter of the annular mouth of the air passage.

3. The dispensing device of claim 1, wherein the dispensing passage is arranged concentrically with respect to the annular mouth of the liquid passage and the air passage.

4. The dispensing device of claim 1, wherein the valve body is substantially conical.

5. The dispensing device of claim 1, wherein the valve body comprises a through-opening which forms a part of the dispensing passage.

6. The dispensing device of claim 1, wherein the valve body is elastic.

7. The dispensing device of claim 1, wherein the dispensing device is substantially circular-symmetrical about a center axis of symmetry and the liquid to be dispensed, during dispensing, moves in a direction relative to the direction of the center axis of symmetry.

8. The dispensing device of claim 1, wherein the valve body is made from a silicone material.

9. The dispensing device of claim 1, wherein the annular mouth of the liquid passage and/or the air passage comprises an opening.

10. The dispensing device of claim 1, wherein the annular mouth of the liquid passage and/or the air passage comprises several openings each, in the rest position, being covering by the valve body.

11. The dispensing device of claim 1, wherein the dispensing device comprises a sealing cap, which can be moved between an open position, in which a foam can be dispensed by squeezing the container, and a closed position, in which the dispensing opening is sealed.

12. The dispensing device of claim 1, wherein the valve body comprises an edge which extends freely on all sides and which serves as a valve for an aeration opening in the housing for aerating the container.

13. A foam-forming assembly for forming a foam, comprising:

a housing having an air passage and a liquid passage, each of which ending in a mouth and being in communication with a dispensing passage which ends in a dispensing opening, and a valve body which, in a rest position, covers the mouth of the liquid passage and the mouth of the air passage in a sealing manner in order to prevent a flow from the liquid passage and the air passage to the dispensing passage, and which, during dispensing, opens the mouth of the liquid passage and the mouth of the air passage in order to allow mixing of air and liquid to take place in the dispensing passage, wherein the mouth of the air passage and the mouth of the liquid passage are substantially annular and are arranged substantially concentrically with respect to one another.

14. A squeeze foamer for dispensing a foam, comprising a manually compressible container for storing a liquid and air, and foam-forming assembly according to claim 13, mountable on or in an opening of said container, the air passage and liquid passage being in fluid communication with the container.

15. A dispensing device for dispensing a foam comprising a foam-forming assembly according to claim 13, in which the liquid passage and air passage are connected with a liquid source comprising a liquid under pressure and a gas source comprising a gas under pressure, respectively.

16. A dispensing device for dispensing a foam comprising a foam forming assembly according to claim 13, in which the liquid passage and the air passage are in fluid communication with a container comprising a foamable liquid and a gas, in particular air, wherein the foamable liquid and gas are pressurized or can be pressurized.

* * * * *